United States Patent [19]

Flaig

[11] Patent Number: 4,457,727

[45] Date of Patent: Jul. 3, 1984

[54] MARINE PROPULSION DEVICE ENGINE COOLING SYSTEM

[75] Inventor: John D. Flaig, Libertyville, Ill.

[73] Assignee: Outboard Marine Corporation, Waukegan, Ill.

[21] Appl. No.: 269,640

[22] Filed: Jun. 2, 1981

[51] Int. Cl.[3] ..... B63H 21/26

[52] U.S. Cl. ..... 440/88; 123/41.13

[58] Field of Search ..... 123/41.08, 41.05, 41.13, 123/41.44; 236/34.5, 34; 440/88

[56] References Cited

U.S. PATENT DOCUMENTS

| | | | |
|---|---|---|---|
| 2,299,321 | 10/1942 | Hampton | 123/41.13 |
| 2,926,853 | 3/1956 | Wood | 236/34 |
| 3,918,418 | 11/1975 | Horn | 123/41.08 |
| 4,011,032 | 3/1977 | Steinwart et al. | 123/41.13 |
| 4,319,547 | 3/1982 | Bierling | 123/41.08 |

FOREIGN PATENT DOCUMENTS

| | | | |
|---|---|---|---|
| 975780 | 11/1964 | United Kingdom | 123/41.13 |

*Primary Examiner*—Trygve M. Blix
*Assistant Examiner*—Thomas J. Brahan
*Attorney, Agent, or Firm*—Michael, Best & Friedrich

[57] ABSTRACT

A marine propulsion device is provided wherein the flow of cooling water through the engine is controlled by a thermostat which controls the flow of cooling water in response to change in the temperature of the engine when the engine is operated at a low speed. The thermostat is supported in a flow restricting position when the engine speed is low but is moved to a position providing for increased water flow when the engine reaches an increased speed.

12 Claims, 2 Drawing Figures

MARINE PROPULSION DEVICE ENGINE COOLING SYSTEM

FIELD OF THE INVENTION

The invention relates to marine propulsion devices and more particularly to means for controlling the flow of cooling water through the engine of a marine propulsion device.

BACKGROUND PRIOR ART

The prior art marine propulsion devices such as outboard motors have commonly included an engine including a thermostat, the thermostat allowing the cooling system water to warm to a preset temperature when the engine is running at low speeds, and maintaining that temperature by opening and closing a water inlet port to thereby allow relatively small amounts of fresh cooler water to enter the engine, thereby maintaining the system at the desired temperature. At higher engine speeds it is desirable that the engine run at cooler temperatures. Accordingly, substantially increased amounts of cooler fresh water must be introduced into the engine. This has been accomplished in the prior art arrangements by the provision of a relief valve which is placed in parallel with the thermostat and which permits increased amounts of water to be forced into the engine at the high engine speeds. The water pump of the engine is driven by the engine, and the speed of the water pump and the water pressure produced by the water pump are, therefore, proportional to the engine speed. Once the engine reaches an increased speed, the water pressure produced by the water pump is sufficient to cause the spring loaded relief valve to open and to thereby cause an increased flow of water into the engine.

One of the features of the prior art systems is that two separate valves are required, the thermostat and the pressure relief valve. Additionally, the spring loaded or spring biased pressure relief valve restricts the flow of water through the engine since it is biased toward a closed position. Furthermore, the opening of the relief valve is controlled by the pump pressure and is not directly dependent upon the engine speed.

One example of an engine cooling system valve arrangement is illustrated in U.S. patent application Ser. No. 231,982, filed Feb. 6, 1981, that application being titled "Cooling System With Removable Valve Member" and being assigned to the assignee of the present invention.

Attention is also directed to the U.S. Nallinger Pat. No. 2,622,572, issued Dec. 23, 1952; the U.S. Woods Pat. No. 2,816,711, issued Dec. 17, 1957; the U.S. Middleton Pat. No. 2,833,478, issued May 6, 1958; the U.S. Woods Pat. No. 2,884,198, issued Apr. 28, 1959; French Pat. No. 1,137,376 and German Pat. No. 885,789.

SUMMARY OF THE INVENTION

The invention provides a marine propulsion device comprising an engine including a coolant conduit having an upstream portion, a passage portion and a downstream portion. The engine also includes a throttle controlling the speed of the engine. Means are also provided for controlling the flow of cooling water through the coolant conduit. The controlling means includes a thermostat located adjacent the passage portion and having means for controlling the flow of water through the coolant conduit in response to change in the temperature of the engine, and means for causing movement of the thermostat to a flow restricting position when the engine speed is slow and for causing movement of the thermostat to a position providing for increased fluid flow when the engine speed reaches an increased speed.

One of the features of the invention is the provision in the means for causing movement of the thermostat of a housing having a first chamber and a second chamber, a diaphragm separating the chambers, the thermostat being connected to the diaphragm and being moved by the diaphragm in response to changes in pressure in the chambers, an increase in pressure in the first chamber with respect to the pressure in the second chamber causing movement of the thermostat toward the valve seat, and a decrease in pressure in the first chamber with respect to the second chamber causing movement of the thermostat away from the valve seat.

Another of the features of the invention is the provision of means for connecting the upstream portion of the coolant conduit to the first chamber, and means for controlling fluid pressure in the first chamber including valve means for selectively causing a decrease in fluid pressure in the first chamber in response to an increase in the speed of the engine to an increased speed, thereby causing movement of the thermostat away from the valve seat.

Another of the features of the invention is the provision in the means for selectively causing a decrease in fluid pressure in the first chamber of a vent conduit connected to the first chamber for selectively venting the first chamber, and a valve for controlling the flow of water through the vent conduit. Means are also provided for causing the valve to close the vent conduit when the engine speed is less than the increased speed and to open the vent conduit when the engine speed reaches this increased speed whereby the first chamber is vented and the thermostat is caused to move away from the valve seat to thereby cause increased water flow.

The invention also includes a marine propulsion device comprising an engine including a coolant conduit having an upstream portion, a passage portion, and a downstream portion. The engine also includes a throttle for controlling the speed of the engine, and means for controlling the flow of cooling water through the coolant conduit. The controlling means includes means for increasing the amount of water flowing through the passage portion in response to an increase in the temperature of the engine and for decreasing the amount of water flowing through the passage portion in response to a decrease in the temperature of the engine. The means for increasing the amount of water flow in response to an increase in temperature includes a thermostat located adjacent the passage portion, at least a portion of the thermostat forming a valve member selectively engageable with the valve seat to restrict flow of water through the passage portion. Means are also provided for selectively causing movement of the valve member of the thermostat away from the valve seat when the engine speed is increased.

In one embodiment of the invention the means for causing movement of the thermostat includes a housing having a first chamber and a second chamber, a flexible diaphragm separating the first and second chambers and being movable in response to changes in pressure in the chambers, the thermostat being connected to the diaphragm for movement with the diaphragm, and such that an increase in pressure in the first chamber with respect to the pressure in the second chamber causes movement of the valve member toward the valve seat, and a decrease in pressure in the first chamber with respect to the second chamber causes movement of the valve member away from the valve seat.

Another of the features of the invention is the provision of means for connecting the supply passage to the first chamber, and means for selectively venting the first chamber in response to an increase in the speed of the engine, the means for venting including a vent conduit and a valve for selectively permitting water to be vented from the first chamber through the vent conduit.

Various other features and advantages of the invention will be apparent by reference to the following description, to the claim, and to the drawings.

Figure 1:
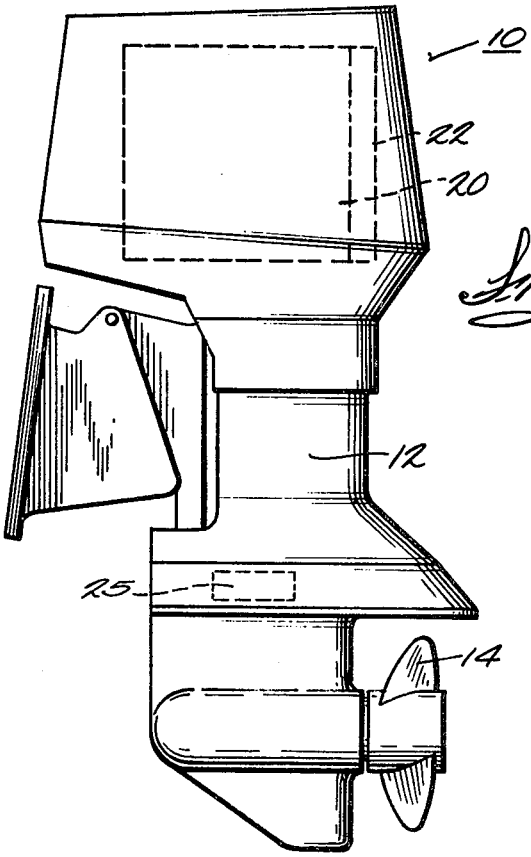
FIG. 1 is a side elevation view of a marine propulsion device embodying the invention.

Before explaining one embodiment of the invention in detail, it is to be understood that the invention is not limited in its application to the details of contruction and to the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 2:
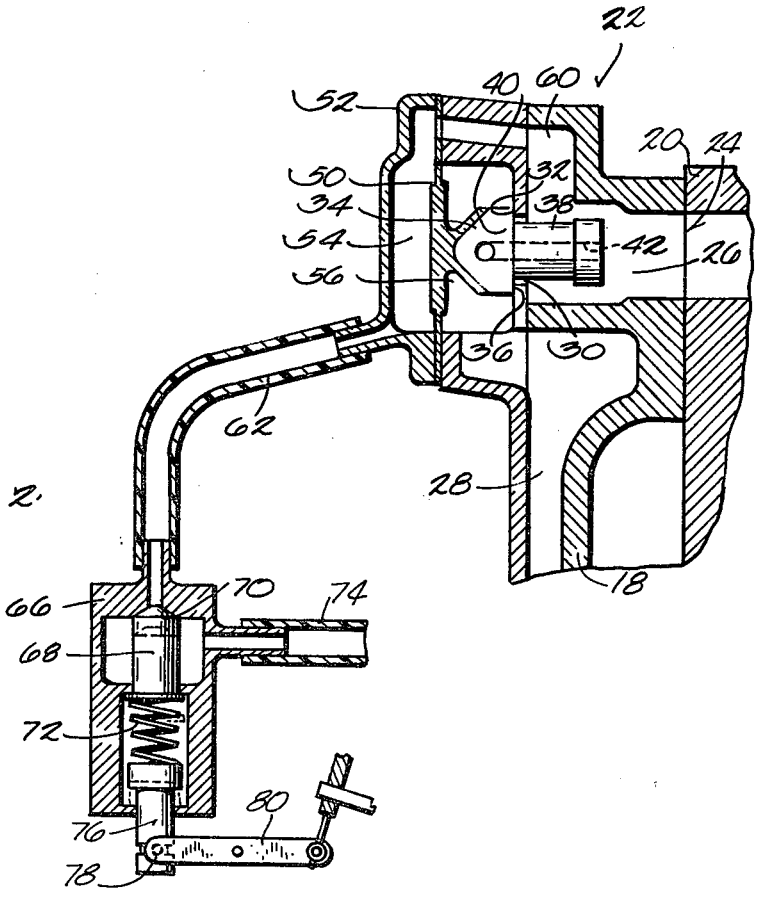
FIG. 2 is a cross section view of an engine cooling system embodying the invention and employed in the outboard motor illustrated in FIG. 1.

Illustrated in FIG. 1 is a marine propulsion device comprising an outboard motor 10, the outboard motor 10 being adapted to be supported on a boat and including a lower unit 12 supporting a propeller 14. The outboard motor 10 also includes an engine including and engine block 20, and a cylinder head 22. As shown in FIG. 2, the engine block 20 and cylinder head 22 include a coolant conduit or passage 23 (FIG. 2). The coolant conduit 24 communicates with the coolant passages in the engine block 20 and is shown as including an upstream portion 26, a downstream portion 28, and a passage portion 30 including an annular valve seat 32 and providing communication between the upstream and downstream portions 26 and 28. The outboard motor 10 also includes means for providing a flow of cooling water through the engine and through the coolant conduit 24. This means for providing a flow of cooling water through the engine can be a conventional pump 25 and will not be described in detail. The cooling water is intended to flow through the engine to maintain a controlled temperature in the engine. At low speeds, the engine is intended to operate at relatively high temperatures, and only a relatively small amount of water is pumped through the engine. However, when the engine speed is increased, it is desirable that the engine temperature be reduced by providing a substantially increased flow of water through the engine.

In order to provide for such a flow of cooling water through the engine means are provided for varying the flow of cooling water through the engine and coolant conduit 24 in response to the temperature of the engine and for increasing the flow of cooling water through the engine and the coolant conduit 24 as the engine temperature increases and for decreasing the flow of water through engine and the coolant conduit 24 as the engine temperature decreases. The means for controlling the flow of cooling water through the engine also includes means for providing substantially unrestricted flow of water through the engine as the engine reaches an increased speed.

The means for varying the flow of cooling water through the engine in response to the temperature of the engine includes a thermostat 34 which is housed in the passage portion 30 and which provides for a limited fluid flow therethrough. In the illustrated construction, the body of the thermostat 34 is constructed to include a valve member engageable against the valve seat 32 so as to prevent fluid flow around the thermostat and through the passage portion 30. More particularly, the thermostat 34 includes a generally cylindrical body 38 which extends through the passage portion 30. The body 38 includes a circumferential flange 40 having a face 36 which is engageable against a complementary planar face of the valve seat 32. The thermostat 34 can have a conventional internal structure including one or more central longitudinally extending bores 42, the bores 42 providing for flow of water through the thermostat from the upstream portion 26 to the downstream portion 28. The thermostat 34 also includes conventional internal means (not shown) for restricting the flow of water through the bores 42 at low engine temperatures and for providing for an increase in the water flow through the bores 42 as the temperature of the engine increases.

As previously stated, the means for controlling the flow of cooling water also includes means for providing a substantially unrestricted flow of cooling water through the engine in response to an increase in the speed of the engine to a selected speed. This means includes means for causing movement of the flange 40 of the thermostat 34 away from the valve seat 32 when the engine speed increases, thereby providing substantially unrestricted flow of cooling water through the passage portion 30. The means for causing movement of the thermostat 34 includes a diaphragm 50 generally bisecting a diaphragm housing 52 and dividing it into a first chamber 54 and a second chamber 56. The thermostat 34 is attached or bonded to the diaphragm 50 whereby movement of the diaphragm 50 is transmitted to the thermostat. The diaphragm housing 52 is located such that water flowing through the passage portion 30 flows into the second chamber 56 of the diaphragm housing 52. The second chamber 56 also communicates with the downstream portion 28 of the coolant conduit 24 whereby water flowing through the coolant conduit flows sequentially through the passage portion 30, through the second chamber 56 and then into the downstream portion 28.

Means are further provided for maintaining fluid pressure on the diaphragm 50 when the engine is running at a low speed to thereby cause the thermostat flange 40 to be forced against the valve seat 32 and to prevent flow of cooling water through the passage portion 30. This means also includes means for reducing the pressure on the diaphragm 50 when the speed of the engine reaches an increased speed. The means for maintaining fluid pressure on the diaphragm 50 includes a water passage 60 between the upstream portion 26 of the coolant conduit 24 and the first chamber 54. Also included is a vent conduit 62 which extends from the first chamber and is adapted to selectively dump the water from the first chamber 54. Valve means are provided in the vent conduit 62 to selectively permit water to be discharged through the conduit 62 from the first chamber 54. While the valve means can have various constructions, in the illustrated arrangement, the valve means comprises a valve body 66 connected to the conduit 62. A moveable valve member 68 is housed in the valve body 66 and is biased against a valve seat 70 by a valve spring 72. Means are further provided for causing the valve member 68 to move away from the valve seat 70 when the engine speed reaches an increased speed to permit flow of water from the first chamber 54 through the conduit 62, past the valve seat 70 and through a dump conduit 74. Means are also provided for permitting movement of the valve member 68 away from the valve seat 70 when the throttle is moved sufficiently to cause the engine speed to reach the increased speed. While this means can have various contructions, in the illustrated arrangement the valve member 68 is supported by a compression spring 72. The compression spring 72 is in turn supported by a movable member 76 connected to an end 78 of the engine throttle lever 80.

In operation, when the engine speed is at low speed, the thermostat flange 40 is maintained against the valve seat 32 and fluid flow through the vent conduit 62 is prevented. Accordingly, the water pressure in the first chamber 54 is substantially the same as the water pressure in the upstream portion 26 of the coolant conduit 24. Since the diaphragm 50 is larger in cross sectional area than the passage portion 30, the force of the water pressure on the diaphragm 50 forcing the thermostat toward a closed position is greater than the force generated by the water pressure on the thermostat. Accordingly, the thermostat flange 40 is maintained in engagement against the valve seat 32, and the flow of water through the coolant conduit 24 is controlled entirely by the flow of water through the bores 42 of the thermostat.

As the throttle lever 80 is moved to cause the engine to reach an increased speed, the end 78 of the throttle lever 80 will cause movement of the movable member 76 away from the valve seat thereby decreasing the force of the spring 72 on the movable valve member 68. The water pressure in the conduit 62, will then cause movement of the valve member 68 away from the valve seat 70 and permit the water in the first chamber 54 to be vented through the conduits 62 and 74. This results in a substantial decrease in the water pressure in the first chamber 54, and the force on the diaphragm 50 by the water pressure in the first chamber 54 is substantially reduced. Accordingly, the water pressure on the thermostat 34 can then force the thermostat to the left as seen in FIG. 2 and cause the flange 40 of the thermostat to move away from the valve seat 32 thereby permitting a substantially increased flow of cooling water through the passage portion 30 and through the engine.

If the throttle is moved to cause the engine speed to decrease, the valve member 68 will be once again moved into engagement with the valve seat 70 thereby preventing fluid flow through the vent conduit 62 and causing an increase in the water pressure in the first chamber 54. Accordingly, the flange 40 of the thermostat 34 is forced against the valve seat 32 thereby preventing the flow of cooling water around the thermostat and through the passage portion 30. Once again the flow of cooling water is restricted to that which flows through the thermostat and is dependent upon the engine temperature.

Various features of the invention are set forth in the following claims.

I claim:

1. A marine propulsion device comprising an engine including a coolant conduit having an upstream coolant conduit portion, a downstream coolant conduit portion, and a passage portion extending between said upstream portion and said downstream portion and including a valve seat, a throttle movable to control the speed of the engine, and means for controlling the flow of coolant through the coolant conduit, said controlling means including a thermostat located adjacent said passage portion and being movable relative to said valve seat to permit coolant flow through said passage portion independently of temperature, said thermostat including means for permitting coolant flow through said passage portion in response to a temperature above a predetermined level and independently of movement of said thermost relative to said valve seat, and means for causing movement of said thermostat relative to said valve seat in response to throttle movement and independently of temperature.

2. A marine propulsion device as set forth in claim 1 wherein said thermostat includes a valve member engageable with said valve seat for restricting coolant flow through said passage portion, and wherein said means for controlling coolant flow through the coolant conduit includes means for supporting said thermostat for movement from a first position wherein said valve member engages said valve seat to a position wherein said valve member is spaced from said valve seat.

3. A marine propulsion device as set forth in claim 2 wherein said means for causing movement of said thermostat includes a housing having a first chamber and a second chamber, a diaphragm separating said chambers, said thermostat being connected to said diaphragm and being moved by said diaphragm in response to changes in pressure in said chambers.

4. A marine propulsion device as set forth in claim 3 wherein an increase in pressure in said first chamber with respect to the pressure in said second chamber causes movement of said thermostat toward said valve seat, and a decrease in pressure in said first chamber with respect to said second chamber causes movement of said valve member away from said valve seat.

5. A marine propulsion device as set forth in claim 4 and further including means connecting said upstream coolant conduit portion with said first chamber, and means for controlling fluid pressure in said first chamber including means for selectively causing a decrease in fluid pressure in said first chamber in response to throttle movement to a high speed setting.

6. A marine propulsion device as set forth in claim 5 wherein said means for selectively causing a decrease in fluid pressure in said first chamber includes a vent conduit connected to said first chamber for selectively venting said first chamber, valve means for controlling coolant flow through said vent conduit, and means for causing said valve means to close said vent conduit when said throttle is moved to a low speed setting and to open said vent conduit when said throttle is moved to a high speed setting.

7. A marine propulsion device comprising an engine including an engine block having a coolant conduit having an upstream coolant conduit portion, a downstream coolant conduit portion, and a passage portion extending between said upstream portion and said downstream portion and including a valve seat, a movable throttle for controlling the speed of the engine, and means for controlling the flow of coolant through the coolant conduit, said controlling means including means for varying the amount of coolant flowing through said passage portion in response to throttle movement and including a valve member selectively engageable with said valve seat, and means operatively connected between said throttle and said valve member for selectively causing movement of said valve member relative to said valve seat in response to throttle movement, and means for varying the amount of coolant flowing through said passage portion in response to temperature variation and independently of valve member movement relative to said valve seat and including a thermostat.

8. A marine propulsion device as set forth in claim 7 wherein said thermostat includes a body having a flange, said flange forming said valve member.

9. A marine propulsion device comprising an engine including an engine block having a coolant conduit having an upstream coolant conduit portion, a downstream coolant conduit portion, and a passage portion extending between said upstream portion and said downstream portion and including a valve seat, a movable throttle for controlling the speed of the engine, and means for controlling coolant flow through the coolant conduit, said controlling means including means for varying the amount of coolant flowing through said passage portion in response to temperature variation and including a thermostat, and means for varying the amount of coolant flowing through said passage portion in response to throttle movement and including a valve member selectively engageable with said valve seat, and means operatively connected between said throttle and said valve member for selectively causing movement of said valve member relative to said valve seat in response to throttle movement, said means for causing movement of said valve member including a housing having a first chamber and a second chamber, a flexible diaphragm separating said first and second chambers and being movable in response to changes in pressure in said chambers, said thermostat being connected to said diaphragm for movement with said diaphragm.

10. A marine propulsion device as set forth in claim 9 wherein an increase in pressure in said first chamber with respect to the pressure in said second chamber causes movement of said valve member of said thermostat toward said valve seat, and a decrease in pressure in said first chamber with respect to said second chamber causes movement of said valve member of said thermostat away from said valve seat.

11. A marine propulsion device as set forth in claim 10 and further including means for connecting said upstream cooling conduit portion to said first chamber, and means for selectively venting said first chamber, and means for selectively venting said first chamber when said engine reaches said increased speed, said means for venting including a vent conduit and a valve displacable in response to throttle movement for selectively permitting water to be vented from said first chamber through said vent conduit.

12. A marine propulsion device comprising an engine including an engine block having a coolant conduit having an upstream coolant conduit portion, a downstream coolant conduit portion, and a passage portion extending between said upstream portion and said downstream portion and including an outlet leading to said downstream portion, a movable throttle for controlling the speed of the engine, and means for controlling coolant flow through said passage portion including a valve member movable relative to and selectively engageable with said outlet to control coolant flow through said passage portion in response to throttle movement and independently of temperature, and thermostatic means for varying the coolant flow through said passage portion in response to temperature variation and independently of valve member movement relative to said outlet.

* * * * *

UNITED STATES PATENT AND TRADEMARK OFFICE

CERTIFICATE OF CORRECTION

PATENT NO. : 4,457,727

DATED : July 3, 1984

INVENTOR(S) : John D. Flaig

It is certified that error appears in the above-identified patent and that said Letters Patent are hereby corrected as shown below:

Column 3, line 26, "contruction" should be -- construction --.

Column 3, line 44, "23" should be -- 24 --.

Column 6, Claim 1, line 21, "thermost" should be -- thermostat--.

Column 8, Claim 11, line 15, "cooling" should be -- coolant --.

Column 8, Claim 11, line 16, after "chamber", insert -- in response to throttle movement to a high speed setting --.

Column 8, Claim 11, lines 17 and 18, delete "and means for selectively venting said first chamber when said engine reaches said increased speed,".

Column 8, Claim 11, line 21 "water" should be -- coolant --.

Signed and Sealed this

*Ninth* Day of *April 1985*

[SEAL]

*Attest:*

DONALD J. QUIGG

*Attesting Officer*

*Acting Commissioner of Patents and Trademarks*